252-104 AU 166 EX
1/5/82 XR 4,309,298

United States Patent [19]
Adrian et al.
[11] 4,309,298
[45] Jan. 5, 1982

[54] OXIDATIVE DESIZING AGENT AND PROCESS FOR OXIDATIVE DESIZING

[75] Inventors: Klaus Adrian, Frankfurt am Main; Günter Rösch, Bad Soden am Taunus, both of Fed. Rep. of Germany

[73] Assignee: Hoechst Aktiengesellschaft, Fed. Rep. of Germany

[21] Appl. No.: 135,160

[22] Filed: Mar. 28, 1980

[30] Foreign Application Priority Data

Apr. 2, 1979 [DE] Fed. Rep. of Germany ..... 2913177

[51] Int. Cl.[3] ..... C11D 3/395; C11D 7/54
[52] U.S. Cl. ..... 252/95; 252/104; 8/111; 8/138
[58] Field of Search ..... 252/95, 104; 8/111, 8/138; 134/2

[56] References Cited

U.S. PATENT DOCUMENTS 3,796,601 3/1974 Kindron et al. ..... 8/138 X
3,850,831 11/1974 Hellsten et al. ..... 252/104 X
3,990,908 11/1976 Caropreso et al. ..... 8/138 X

*Primary Examiner*—Mayer Weinblatt
*Attorney, Agent, or Firm*—Connolly and Hutz

[57] ABSTRACT

Novel oxidative desizing agent consisting essentially of from 10 to 80, preferably 50 to 80% by weight of a surfactant and from 20 to 90, preferably 20 to 50% by weight of potassium persulfate. This desizing agent may optionally also contain from 5 to 25% by weight of a solubilizer with a simultaneous reduction of the surfactant and persulfate portions.

3 Claims, No Drawings

OXIDATIVE DESIZING AGENT AND PROCESS FOR OXIDATIVE DESIZING

It is already known to use persulfates for the oxidative desizing of fabrics of cellulose fibers and mixtures thereof with synthetic fibers, since persulfate excellently degrades starches, such as potato starch, rice starch, corn starch and tapioca, which are used for the sizing of fabrics, in the presence of alkali. A drawback of the desizing with persulfates is to be seen in the fact that the cellulose fibers may easily be damaged, which is expressed in a strong increase of the fiber degradation. A fiber (DP value) damaging of this kind is found above all in those cases where the treatment bath does not contain a sufficient amount of alkali, and where an amount of from 3 to 5 g/l of the persulfate is employed which is required for the complete desizing.

It has now been found that an appropriate persulfate-surfactant combination makes it possible to obtain the same desizing effect with a considerably lower persulfate concentration. This reduction of the concentration of the desizing agent having an oxidative effect helps to considerably reduce the fiber degradation.

The invention provides a novel oxidative desizing agent which consists essentially of from 10 to 80, preferably from 50 to 80% by weight of a surfactant and from 20 to 90, preferably from 20 to 50% by weight of potassium persulfate. If required, this desizing agent may also contain from 5 to 25% by weight of a solubilizer, with a simultaneous reduction of the surfactant and persulfate portions.

Suitable surfactants are anionic and non-ionic surfactants, mainly of the following classes of compounds: alkane sulfonates with from 8 to 20 carbon atoms, especially secondary alkane sulfonates, $C_8$–$C_{20}$-alkylbenzene sulfonates, $C_8$–$C_{20}$-olefin sulfonates, $C_{10}$–$C_{18}$-fatty alcohol sulfonates, polyethylene glycols with from 6 to 20 ethylene oxide units, $C_{10}$–$C_{18}$-fatty alcohol oxethylates with from 6 to 24 ethylene oxide units, $C_4$–$C_{12}$-alkylphenol oxethylates with from 6 to 20 ethylene oxide units. Preference is given in particular to the secondary alkane sulfonates, fatty alcohol oxethylates and alkylphenol oxethylates. These surfactants may be present in the desizing agent of the invention by themselves or in combination with one another. There are preferred mixtures in the ratio of from 1:9 to 9:1 of an anionic and a non-ionic surfactant, especially mixtures of secondary alkane sulfonate with fatty alcohol oxethylates and/or alkylphenol oxethylates.

These surfactants are contained in the desizing agent of the invention in the above-specified amount, the balance of 100% being potassium persulfate. It may be advantageous to additionally employ a solubilizer, such as iso-propanol, glycolic acid butyl ester, cyclohexanol or butyl diglycol. The simultaneous use of solubilizers of this kind is particularly recommended if the desizing agent contains a high concentration of anionic surfactant. The solubilizers may amount to 5 to 25% by weight of the desizing agent with a corresponding reduction of the above-specified limiting values for the surfactants and the potassium persulfate.

Said surfactant-persulfate mixture is suitable for the oxidative desizing of fabrics containing cellulose fibers by themselves or in admixture with synthetic fibers. The fabric is impregnated with an aqueous solution of this desizing agent, while simultaneously adding alkali, preferably sodium hydroxide solution. The material thus impregnated is brought to a moisture content of about 100% by squeezing-off and is subsequently treated at 20° to 160° C. over a period of from 30 seconds to 24 hours. The treatment period depends on the temperature and the type of dwelling aggregate pertinent to the respective process. The content of the above-described desizing agent in the aqueous bath is in the range of from 2 to 20, preferably 3 to 8 g/l. The amount of alkali to be added is usually chosen such that the pH value of the bath is always more than 10. For this purpose, there are generally required from 1 to 100 g, preferably from 3 to 40 g/l of solid sodium hydroxide.

After the treatment the fabric is suitably washed with hot water of about 85° to 95° C. for 10 to 60 seconds and subsequently rinsed with cold water. In order to increase the degree of washing, alkali and a detergent are suitably added to the wash water.

This desizing process may also be combined with a common bleaching process. In this case the fabric is impregnated with an aqueous liquor which contains, besides the desizing agent and the alkali in the above-specified amount and composition, from 30 to 60 ml of $H_2O_2$ (of 35% strength) per liter of liquor as well as sodium silicate as stabilizer. The impregnated fabric is again squeezed off to about 100% and stored at room temperature for 6 to 24 hours. Thereafter the fabric is washed, the alkali and detergent being added to the wash water to support the size degradation.

The material treated with the above-described combination of surfactants and persulfate shows a markedly improved breaking up of the cotton seed husks, so that the goods may be bleached within a considerably reduced period during a subsequent bleaching treatment.

Besides, the use of this combination makes it possible to reduce the amount of persulfate required for the desizing to about 25% of the amount which would be necessary for the desizing with persulfate only. By this reduction of the amount of persulfate the damaging of the fibers strongly decreases. In order to obtain these advantages, it is important, according to the invention, not to add the persulfate and the surfactant separately to the impregnation bath, but first to prepare the mixture of persulfate and surfactant and then to add said mixture to the liquor.

The following Examples serve to illustrate the process of the invention, however, without limiting the same. The percentages are percent by weight.

EXAMPLE 1

A cotton twill having been sized with starch is impregnated with an aqueous solution of the following composition:

6% of sodium hydroxide 0.5% of persulfate/surfactant combination of the following composition:

16% of nonylphenol polyglycol ether with 6 to 14 mols of ethylene oxide

38% of secondary $C_{13}$–$C_{18}$-alkane sulfonate (93% strength)

25% of potassium persulfate

21% of glycolic acid-n-butyl ester

The impregnated material is squeezed off to a residual moisture content of 100% and treated with steam in a steamer at 103° to 105° C. Thereafter the material is washed with hot water until it is free from alkali.

The material thus treated shows a degree of whiteness of 62.5%. The degree of desizing measured according to the violet scale TEGEWA is between 8 and 9. The DP (depolymerization) value of the treated material is 2400.

For reasons of comparison the same cotton twill was impregnated with the following aqueous solution prepared directly in the trough of the padder:

6% of sodium hydroxide
0.5% of alkali persulfate
0.5% of wetting agent.

Subsequently the material is treated as has been described in Example 1.

The material thus treated shows a degree of whiteness of 61.0%. The degree of desizing measured according to the violet scale TEGEWA is merely 6. The DP value of the treated material is 2150.

It becomes evident that the desizing effect and the DP degree are considerably higher with the combination of the invention.

EXAMPLE 2

A cotton twill as mentioned in Example 1 is impregnated with an aqueous solution having the following composition:

3% of sodium hydroxide
0.5% of persulfate/surfactant combination of the following composition:
10% of nonylphenol polyglycol ether with 6 to 14 mols of ethylene oxide
40% of secondary $C_{13}$–$C_{18}$-alkane sulfonate (93% strength)
25% of potassium persulfate
25% of glycolic acid-n-butyl ester.

The impregnated material is squeezed off to a residual moisture content of 100%, wound up and then allowed to dwell for 1 hour in a steam atmosphere free from air with a relative moisture content of 100% at 95° C. Subsequently the material is treated as has been described in Example 1. The goods thus treated show a degree of whiteness of 63.0%. The degree of desizing measured according to the violet scale TEGEWA is 8. The DP value of the treated material is 2350.

In this case, too, the material was impregnated for reasons of comparison with a solution of the following composition:

3% of sodium hydroxide
0.5% of alkali persulfate
0.5% of wetting agent.

Thereafter the material is treated as has been described in Example 1. The goods then show a degree of whiteness of 64.0%. The desizing degree measured according to the violet scale TEGEWA is merely 5.

The DP value of the treated material dropped to 2050.

EXAMPLE 3

A cotton twill as mentioned in Example 1 is impregnated with a solution of the following composition:

4% of hydrogen peroxide of 35% strength
2% of sodium silicate of 36° to 38° Bé
1% of sodium hydroxide
0.5% of persulfate/surfactant combination of the following composition:
26% of nonylphenol polyglycol ether having 6 to 14 mols of ethylene oxide
28% of secondary $C_{13}$–$C_{18}$-alkane sulfonate (93% strength)
30% of potassium persulfate
16% of glycolic acid-n-butyl ester.

The impregnated material is squeezed off to a residual moisture content of 100%, wound up on a skein and wrapped into a plastic sheet in order to avoid drying. The skein is allowed to dwell for 16 to 20 hours at room temperature.

Subsequently the material is washed as has been described in Example 1. The goods thus treated show a degree of whiteness of 86%.

The desizing degree measured according to the violet scale TEGEWA is between 8 and 9.

The DP value of the treated material is 2550.

For reasons of comparison the same material was treated with the following solution which had been prepared separately:

40% of hydrogen peroxide of 35% strength
2% of sodium silicate of 36° to 38° Bé
1% of sodium hydroxide
0.5% of alkali persulfate
0.5% of wetting agent.

The impregnated material is squeezed off to a residual moisture content of 100%, wound up on a skein and wrapped into a plastic sheet in order to avoid drying. The skein is allowed to dwell at room temperature for 16 to 20 hours. Subsequently the material is treated as has been described in Example 1.

The goods thus treated show a degree of whiteness of 85.5%.

The desizing degree measured according to the violet scale TEGEWA is 6.

The DP value of the treated material is 2250.

In the same manner as has been described in Examples 1 to 3, the desizing may also be carried out with the following mixtures:

A 70% of non-ionic surfactant,
25% of potassium persulfate,
5% of solubilizer;
B 60% of anionic surfactant,
25% of potassium persulfate,
15% of solubilizer.

In these mixtures the following compounds were employed as surfactants:

$R-O-(CH_2CH_2O)_3-SO_3Na$;
($R=C_{12}/C_{14}$—alkyl)

$R-CH_2O(CH_2CH_2O)_8H$;
($R=C_{12}/C_{15}$—alkyl)

$C_{17}H_{33}-CON(CH_3)-CH_2COONa$;

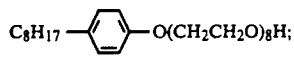

$C_{17}H_{33}-CON(CH_3)-CH_2CH_2SO_3Na$;

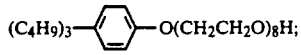

$C_{13}/C_{18}$—sec. alkane sulfonate;

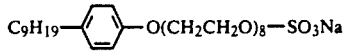

-continued

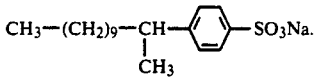

What is claimed is:

1. Oxidative desizing agent consisting essentially of, for use in an impregnation bath, a mixture of from 10 to 80% by weight of a surfactant selected from the group consisting of alkane sulfonates with from 8 to 20 carbon atoms, $C_8$–$C_{20}$-alkyl benzene sulfonates, $C_8$–$C_{20}$-olefin-sulfonates, $C_{10}$–$C_{18}$-fatty alcohol sulfonates, polyethylene glycols with from 6 to 20 ethylene oxide units, $C_{10}$–$C_{18}$-fatty alcohol oxethylates with from 6 to 24 ethylene oxide units, $C_4$–$C_{12}$-alkylphenol oxethylates with from 6 to 20 ethylene oxide units and from 20 to 90% by weight of potassium persulfate, said mixture being prepared before use in said bath.

2. Desizing agent as claimed in claim 1, consisting essentially of from 50 to 80% by weight of a surfactant and from 20 to 50% by weight of potassium persulfate.

3. Desizing agent as claimed in claim 1, containing from 5 to 25% by weight of a solubilizer of the class containing of isopropanol, glycolic acid butylester, cyclohexanol and butyldiglycol.

* * * * *